US005555982A

United States Patent [19]

Kuhn et al.

[11] Patent Number: 5,555,982

[45] Date of Patent: Sep. 17, 1996

[54] CONVERTIBLE SHIPPING CONTAINER-DISPLAY APPARATUS

[75] Inventors: Wayne H. Kuhn, Palos Park; Robert B. Leftwich, Bolingbrook, both of Ill.

[73] Assignee: Stone Container Corporation, Chicago, Ill.

[21] Appl. No.: 365,887

[22] Filed: Dec. 29, 1994

[51] Int. Cl.[6] ..... B65D 5/54; B65D 17/50

[52] U.S. Cl. ..... 206/746; 206/526; 206/772; 229/123.2; 229/240

[58] Field of Search ..... 229/123.2, 240, 229/242; 206/427, 497, 526, 746, 772, 774

[56] References Cited

U.S. PATENT DOCUMENTS

| | | | |
|---|---|---|---|
| 1,991,640 | 2/1935 | Taylor . | |
| 2,152,079 | 3/1939 | Mott . | |
| 2,330,691 | 9/1943 | Darrow . | |
| 2,660,362 | 11/1953 | Schilling . | |
| 2,934,252 | 4/1960 | Wickstrom . | |
| 3,338,404 | 8/1967 | Becker et al. | 206/497 X |
| 3,372,794 | 3/1968 | Kohlhaas . | |
| 3,425,544 | 2/1969 | Ayer et al. . | |
| 3,486,612 | 12/1969 | Kivell | 206/46 |
| 3,533,549 | 10/1970 | Gilchrist . | |
| 3,784,082 | 1/1974 | Hurlock . | |
| 3,870,221 | 3/1975 | Zeitter . | |
| 3,892,348 | 7/1975 | Rohner . | |
| 3,935,943 | 2/1976 | Meyer et al. . | |
| 4,000,811 | 1/1977 | Hardison et al. . | |
| 4,003,514 | 1/1977 | Groser . | |
| 4,058,206 | 11/1977 | Morse et al. . | |
| 4,113,100 | 9/1978 | Soja et al. . | |
| 4,183,436 | 1/1980 | Engelhardt et al. . | |
| 4,185,763 | 1/1980 | Geraedts . | |
| 4,191,288 | 4/1980 | Hostad . | |
| 4,263,769 | 4/1981 | Hanazawa et al. . | |
| 4,427,108 | 1/1984 | Coles et al. . | |
| 4,471,870 | 9/1984 | Uhlig | 206/427 X |
| 4,533,052 | 8/1985 | Fruchey et al. . | |
| 4,563,316 | 1/1986 | Jes . | |
| 4,635,795 | 1/1987 | DeFlander et al. . | |
| 4,813,545 | 3/1989 | Chung et al. . | |
| 4,865,187 | 9/1989 | Zulauf et al. . | |
| 4,871,067 | 10/1989 | Valenti . | |
| 4,911,305 | 3/1990 | Chung et al. . | |
| 4,979,621 | 12/1990 | Chung . | |
| 5,277,360 | 1/1994 | DeMott . | |
| 5,350,111 | 9/1994 | Vosbikian . | |

FOREIGN PATENT DOCUMENTS

| | | |
|---|---|---|
| 0157742 | 10/1985 | European Pat. Off. . |
| 0178717 | 4/1986 | European Pat. Off. . |
| 0235852 | 9/1987 | European Pat. Off. . |
| 2196273 | 3/1971 | France . |
| 2498561 | 7/1982 | France . |
| 382645 | 12/1964 | Switzerland . |
| 1141676 | 1/1969 | United Kingdom . |
| 2008542 | 6/1979 | United Kingdom . |

*Primary Examiner*—Bryon P. Gehman
*Attorney, Agent, or Firm*—Dick and Harris

[57] ABSTRACT

A shipping container apparatus is provided which, upon opening, may be converted to a display apparatus for items shipped and contained therewithin the shipping container. The convertible shipping container—display apparatus includes a cover configured for facilitated opening, to permit access to and viewing of the goods shipped and contained therein.

8 Claims, 2 Drawing Sheets

CONVERTIBLE SHIPPING CONTAINER-DISPLAY APPARATUS

BACKGROUND OF THE INVENTION

The present invention is directed to a shipping container apparatus such as is used for the transportation of consumer goods such as are sold in grocery stores, that is, relatively small items which are shipped and displayed in quantity, and are provided with their own individual labeled containers.

Such consumer goods, which may be as diverse as laundry detergent, breakfast cereals, packaged diapers, and the like, are typically shipped in substantially conventional corrugated paperboard boxes having generally rectangular cross-sections. Such boxes have typically conventional closure flaps which are glued or stapled shut. When such a container is received by an establishment, such as a grocery store, the container is usually opened in a destructive manner, either by cutting, or by brute force ripping open of the container. The result of either method is that the shipping container may be substantially destroyed, has no further utility, and/or may be discarded. The goods are withdrawn from the container, and typically stacked onto conventional store shelving or displays.

It has also become common for storage and display space in such vendor locations to be in short supply, from time to time, prompting the proprietors to be forced to simply stand such cut-open shipping containers, containing the goods, in the aisles, with only the tops open.

It would be desirable to provide a way to reduce the amount of waste which is inherent in the destructive opening of the shipping containers for such goods.

It would additionally be desirable to enable the shipping containers for such goods to have enhanced or lengthened utility.

It would be still further desirable to package and ship such goods to vendors in such a manner as to enhance their attractiveness to such as goods which such vendors would wish to carry.

Accordingly, it is an object of the present invention to provide a shipping container for consumer goods which can be opened by a vendor in a non-destructive manner.

It is a further object of the invention to provide a shipping container which has utility beyond merely serving as a shipping container, upon receipt at a vendor destination.

Yet another object of the invention is to provide a shipping container, which can be converted upon opening, into a display apparatus for the goods contained therein, and which, when stacked atop other similar, unopened containers, can be displayed in a vending establishment without need for special display structures and without utilizing the vending establishment's regular display space.

These and other objects of the invention will become apparent in light of the present specification, claims and drawings.

SUMMARY OF THE INVENTION

The present invention is directed to a shipping container apparatus for goods, which apparatus is operably configured for conversion from a shipping configuration for the containment and transportation of goods to a display configuration for the facilitated presentation and display of the goods contained and shipped therein the apparatus.

In particular, the shipping container apparatus comprises a bottom portion, fabricated from a first material. The bottom portion includes a bottom wall member, and at least two first wall members operably adjoining, at respective bottom edges thereof, the bottom wall member at two substantially opposed first edges thereof the bottom wall member, at least two of the at least two first wall members having respective top edges operably disposed distal to the respective bottom edges thereof, the at least two first wall members being operably arranged relative to the bottom wall member so as to define and partially enclose a goods containing region having at least an open top portion.

The bottom portion further includes at least two second wall members, operably adjoining, at respective bottom edges thereof, the bottom wall member at two substantially opposed second edges thereof the bottom wall member, the opposed second edges of the bottom wall member being operably disposed in substantially alternating relation with the opposed first edges of the bottom wall member, at least one of the at least two second wall members being operably configured so as to permit visual inspection of and access to the goods containing region.

Means for covering the goods containing region are operably configured so as to cover the substantial entirety of the at least two second wall members, at least portions of the top edges of the at least two first wall members, and the open top portion.

The means for covering the goods containing region includes a substantially thin cover sheet member, operably positionable over the at least two second wall members, the at least portions of the top edges of the at least two first wall members, and the open top portion of the goods containing region. The substantially thin cover sheet member is configured from a second, substantially thinner material than the first material.

Means for facilitating conversion of the apparatus from the shipping configuration to the display configuration by conditioning a portion of the substantially thin cover sheet member to be severed and removed in a facilitated manner from a remaining portion of the substantially thin cover sheet member, so as to substantially uncover at least a portion of the open top portion of the goods containing region, are operably associated with the means for covering the goods containing region.

In a preferred embodiment of the invention, the means for facilitating conversion of the apparatus from the shipping configuration to the display configuration by conditioning a portion of the substantially thin cover sheet member to be severed and removed comprises two parallel lines of perforations operably disposed in the substantially thin cover sheet member and extending from positions adjacent one of the bottom edges of one of the at least two second wall members, across the portion of the cover sheet member covering the open top portion of the goods containing region, to positions adjacent the bottom edge of another of the at least two second wall members.

In a preferred embodiment of the invention, the cover sheet member is a sheet of kraft paper material. The bottom wall member, and the at least two first wall members, and the at least two second wall members, are formed from a single blank of container material, which preferably, is fabricated from corrugated paperboard material. The at least two second wall members preferably comprise at least a front wall member and a back wall member.

The shipping container apparatus further comprises a removable wall panel member operably disposed in at least one of the at least two second wall members for facilitating access to the goods containing region upon actuation of the means for facilitating conversion of the apparatus from the shipping configuration to the display configuration by conditioning a portion of the substantially thin cover sheet member to be severed and removed.

In a preferred embodiment of the invention, at least one of the at least two second wall members has a height substantially less than either of the first wall members, and, in turn, less than an overall height of the shipping container apparatus, so as to permit visual inspection of and access to the goods containing region.

DETAILED DESCRIPTION OF THE INVENTION

Figure 1:
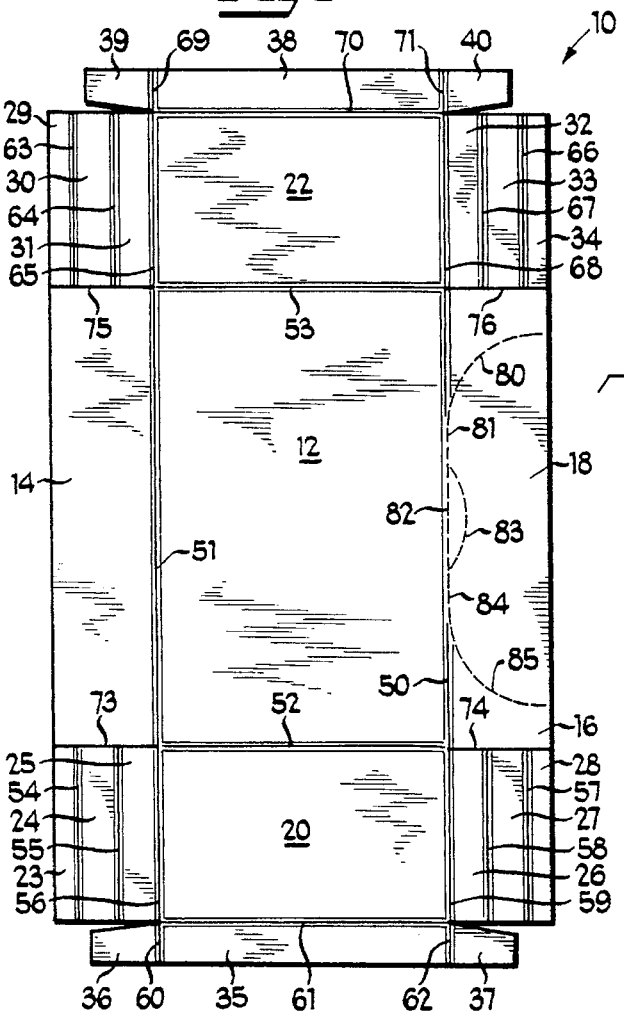
FIG. 1 is a top plan view of a blank for fabrication of a convertible shipping container—display apparatus according to the present invention.

While this invention is susceptible of embodiment in many different forms, there is shown in the drawings and will be described herein in detail, several preferred embodiments, with the understanding that the present disclosure is to be considered as an exemplification of the principles of the invention and is not intended to limit the invention to the embodiments illustrated.

FIG. 1 shows a blank 10, such as may be used to articulate the bottom portion 19 of a shipping container—display apparatus 11 according to the present invention. Blank 10 includes bottom wall member 12, back wall member 14, front wall member 16 (including an optional tear-away panel member 18 demarcated by perforation line 85), side wall members 20 and 22, and stacking support panel members 23–25, 26–28, 29–31, and 32–34. Top panel members 35 and 38, with respective tab members 36, 37 and 39, 40, may also be formed on blank 10. Blank 10 is also provided with fold lines 50–71, cuts 73–76, and perforations 80–85, for facilitating the articulation of blank 10 into bottom portion 19 of display apparatus 11. In a preferred embodiment of the invention, blank 10 is fabricated from corrugated paperboard material, although other suitable sturdy materials may be employed and still be within the scope of the present invention.

Figure 2:
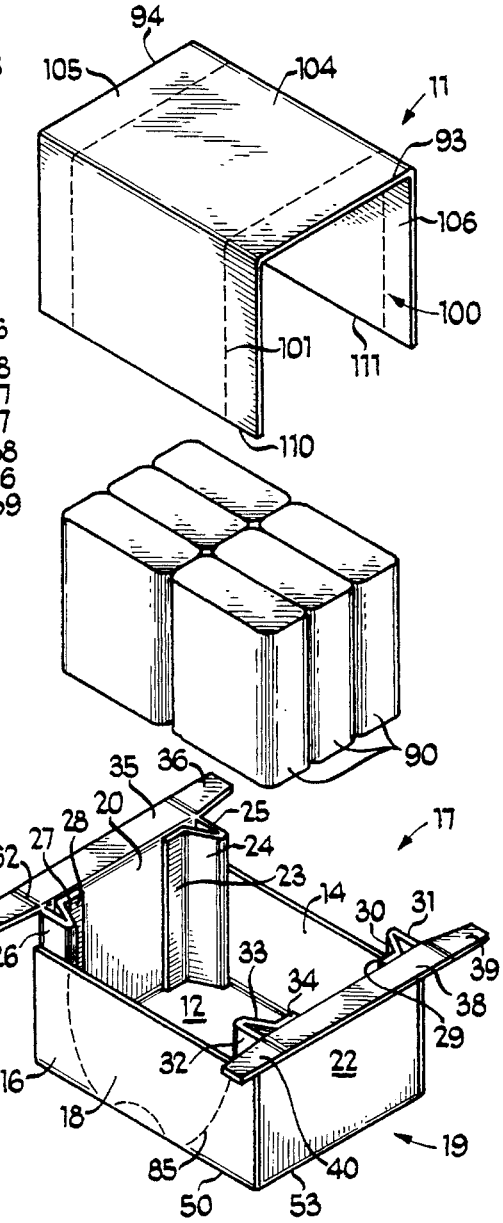
FIG. 2 is an exploded perspective view of an erected and assembled convertible shipping container—display apparatus according to the present invention.

The articulation of blank 10 into bottom portion 19, and subsequent filling and assembly of shipping container—display apparatus 11 may be understood with reference to FIG. 2. As one preferred method of assembly, first one or the other of side wall members 20, 22, is folded up to a substantially perpendicular position relative to bottom wall member 12. Then, the corresponding stacking support panel members 23–25, 26–28, 29–31, and 32–34 are folded as indicated, with panel members 26 and 32 flat against the inside of front wall member 16, panel members 25 and 31 flat against the inside of back wall member 14, panel members 28 and 34 flat against the inside of side wall member 22, and panel members 23 and 29 flat against the inside of side wall member 20. Panel members 26, 27 form a triangular column with a portion of side wall member 20, as do panel members 24 and 25. Panel members 32 and 33 form a triangular column with a portion of side wall member 22, as do panel members 30 and 31. The triangular columns so formed tend to improve the stacking strength of the container apparatus 11. In order to maintain the triangular column configurations once formed, stacking support panel members 23, 28 may be glued, such as by a hot melt glue, to side wall member 20. Similarly, stacking support panel members 29, 34 may be glued to side wall member 22. Other means of affixing the support panel members in place, such as stapling, may be employed without departing from the scope of the present invention.

Front wall member 16 and back wall member 14 are then folded to positions substantially perpendicular to bottom wall member 12, and additional adhesive, such as hot melt glue, may be applied to the facing surfaces of stacking support panel members 25, 31, and back wall member 14, and stacking support panel members 26, 32, and front wall member 16. The resulting structure, bottom portion 19, of shipping container—display apparatus 11 will be that illustrated in FIG. 2.

As can be seen from FIG. 2, the central portions of front wall member 16 and back wall member 14, between stacking support panel members 26, 32, and/or 25, 31, do not extend to the full height of their adjacent stacking support panel members. In an alternative embodiment of the invention, the central portions of front wall member 16 and back wall member 14, may be so configured to extend to the full height of the stacking support panel members, but at least one of the front wall member 16 and the back wall member 16 should be provided with a tear-away panel member, such as panel member 18, to enable visual inspection, display and access to the goods contained therein. Bottom portion 19 of shipping container—display apparatus 11 then may be filled with goods 90. Due to the presence of the triangular columns formed by the stacking support panel members, bottom portion 19 is most advantageously configured for the packaging, shipment and display of goods having rounded configurations, such as bottles, or goods having variable configurations, such as paper goods or bags containing fluent goods. Goods having rectangular configurations may also be packaged in apparatus 11, but will not be capable of occupying all of the available interior space of the goods containing region defined by the wall members, the triangular columns and the top panel members.

After filling bottom portion 19 with goods 90, top panel members 35, and 38, if provided, may be folded over to rest atop the triangular columns formed by the stacking support members, and tab members 36, 37, 39, 40 are folded down and affixed to the outer faces of stacking support panel members 25, 26, 31, 32, respectively.

A cover sheet 100, which preferably is configured from a strong but thin and supple paper material, such as kraft paper, is then affixed over the top, front and back of the filled bottom portion 19, such as by adhesive either applied to top panel members 35, 38, front wall member 16 and back wall member 14, or coated onto corresponding locations on the inner/bottom surfaces of cover sheet 100 and activated prior to positioning onto bottom portion 19. In a preferred embodiment of the invention, the adhesive will be so positioned on bottom portion 19, or coated onto cover sheet 100, so as to contact only the regions of cover sheet 100 which are at or near the side edges 93, 94. Cover sheet 100 covers substantially the entire height of both front wall member 16 and back wall member 14, and may even be so long as to extend around the bottom side of bottom wall member 12 if so desired. Preferably, whichever approach is employed, no adhesive should be positioned so as to make contact with either goods 90, tear-away panel member 18, or indeed, any central portion of either front wall member 16 or back wall member 14, that is between the inner edges of top panel members 35, 38.

Cover sheet 100 should also be provided with perforations 101, which may either be in the form of two parallel lines of perforations which extend from front edge 110 rearwardly across the top of cover sheet 100, to rear edge 111, so as to subdivide cover sheet 100 into center section 104, and side strips 105 and 106. Side strips 105, 106 preferably will have widths substantially equal to the widths of top panel members 35 and 38, respectively.

Once the adhesive holding cover sheet 100 to bottom portion 19 has set, shipping container—display apparatus 11 is ready for shipment. The stacking support members facilitate stacking of multiple ones of the apparatus 11.

When apparatus 11 is received by a vending establishment, such as a grocery store or the like, shipping container—display apparatus 11 may be opened by grasping cover sheet 100 at either front edge 110 or rear edge 111, at one of the central positions between side edges 93, 94, where no adhesive is present, and tearing the central portion 104, along perforation(s) 101, so as to expose goods 90. In addition, if a tear-away panel member 18 is provided, that may also be removed, so as to facilitate removal of goods 90 from apparatus 11. The opened apparatus 11 may then be positioned, for example atop a stack of unopened apparatus 11, and serve as the vending display for goods 90, without the need for special display apparatus, or occupying the vending establishment's regular display and storage structures, or shelf space, if so desired.

Figure 3:
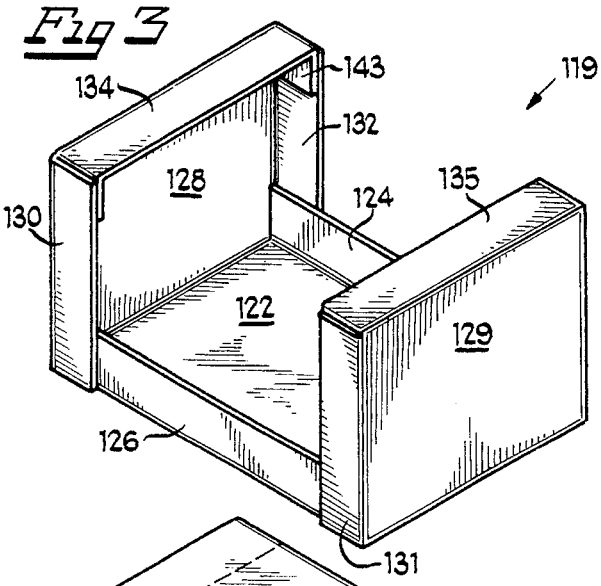
FIG. 3 is a top right perspective view of an alternative embodiment of the convertible shipping container—display apparatus.
Figure 4:
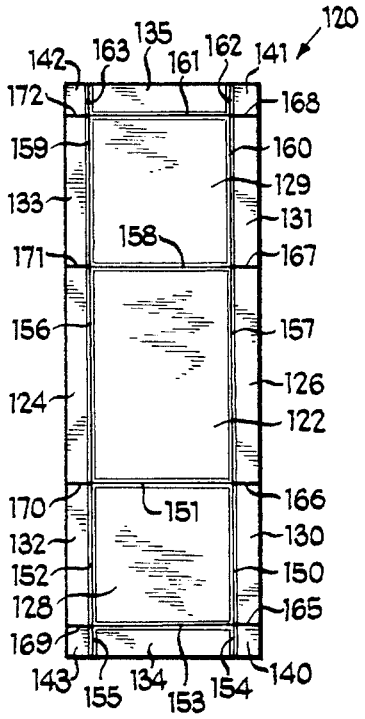
FIG. 4 is a plan view of the blank for forming the container bottom, according to the embodiment of FIG. 3.

FIGS. 3 and 4 illustrate an alternative embodiment for the bottom portion 119 of a convertible shipping container—display apparatus, according to the present invention. Blank 120 includes bottom wall member 122, back wall member 124, front wall member 126, side wall members 128 and 129, face panel members 130–133, top panel members 134–135, and tab members 140–143. Blank 120 is also provided with fold lines 150–163, and cuts 165–172, for facilitating the articulation and assembly of bottom portion 119. The articulation of blank 120 into bottom portion 119 may be understood with reference to FIG. 3. As one preferred method of assembly, back wall member 124 and front wall member 126 are folded up to a perpendicular position relative to bottom wall member 122. Then, side wall members 128 and 129 are raised. Top panel members 134, 135 are folded so as to extend inwardly and substantially parallel to bottom wall member 122. Tab members 140–143 are folded downward. Face panel members 130–134 are folded so as to be substantially parallel to and in overlying relation to their respective adjacent back wall member 124 and front wall member 126, and tab members 140–144. An adhesive, such as a hot melt glue, or stapling, may be used to affix face panel members 130–134 to front wall member 126, back wall member 124 and tab members 140–144, where the respective panel members, wall members and tab members overlie and contact one another.

Once erected, bottom portion 119 is filled in the manner previously described with respect to the first preferred embodiment, and a cover sheet (not shown) having substantially the same configuration as cover sheet 100, is laid over bottom portion 119, and affixed in place in substantially the same manner, with the adhesive running upwardly along face panel members 130 and 131, back across top panel members 134 and 135, and down face panel members 132 and 133, or being coated onto the underside of the cover sheet as previously described. Since no adhesive contacts or is applied to the cover sheet where it would overlie front wall member 126 and back wall member 124, between their respective adjacent face panel members 130–131, and 132–133, the cover sheet can be removed in the previously described manner by grasping and pulling, to cause separation of the center section of the cover sheet, along the perforations, leaving the side strips in place on the face panel members and top panel members, as previously described. The embodiment of FIGS. 3 and 4 is particularly suited to be advantageously used for the packaging and display of goods which have rectangular configurations or are in rectangular boxes, but which may still require the additional protection and support during stacking which is provided by top panel members 134, 135.

Figure 5:
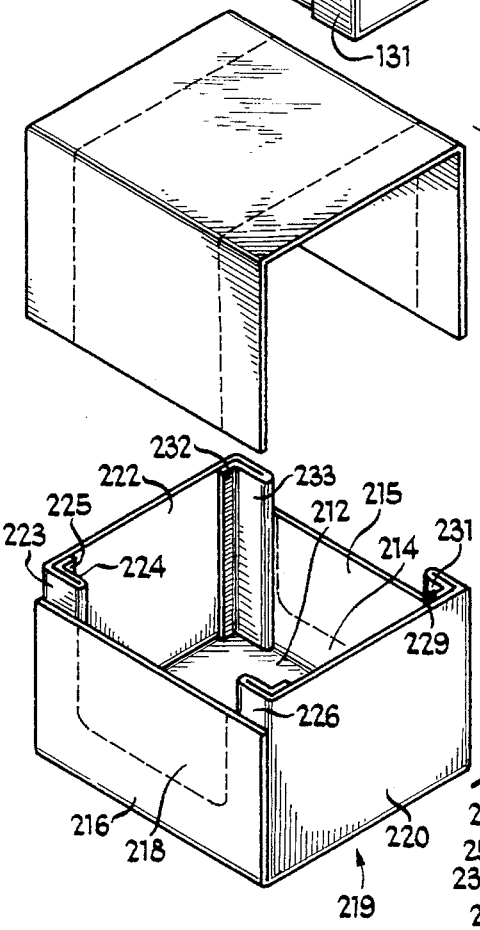
FIG. 5 is a top right perspective view of another alternative embodiment of the convertible shipping container—display apparatus.
Figure 6:
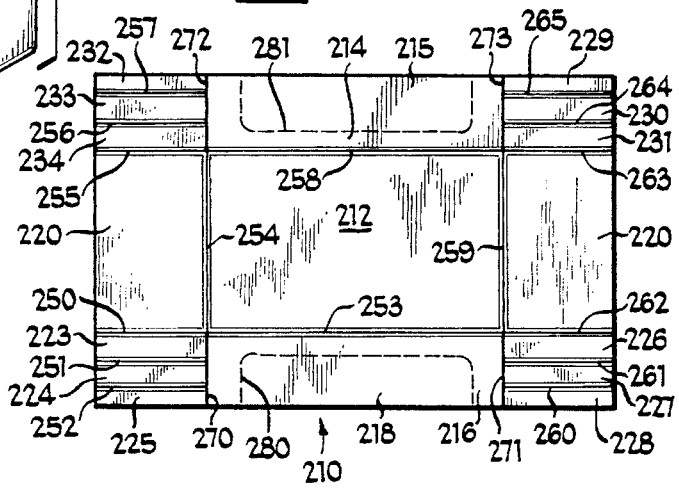
FIG. 6 is a plan view of the blank for forming the container bottom, according to the embodiment of FIG. 5.

FIGS. 5 and 6 show a blank 210, forms an alternative embodiment bottom portion 219. Blank 210 includes bottom wall member 212, back wall member 214 (including an optional tear-away panel member 215), front wall member 216 (including an optional tear-away panel member 218), side wall members 220 and 222, stacking support panel members 223–225, 226–228, 229–231, and 232–234. Blank 210 is also provided with fold lines 250–265, cuts 270–273, and perforations 280, 281 for facilitating the articulation and assembly of bottom portion 219.

The articulation of blank 210 into bottom portion 219 may be understood with reference to FIG. 6. As one preferred method of assembly, first side wall members 220, 222, are folded up to perpendicular positions relative to bottom wall member 212. Then, the corresponding stacking support panel members 223–225, 226–228 and 229–231, 232–234 are folded and affixed into the relative positions indicated in FIG. 5, such that panel members 223 and 226 are flat against the inner side of front wall member 216, panel members 231 and 234 are flat against the inner side of rear wall member 214, panel members 224, 227, 230 and 233 are folded flat against panel members 223, 226, 231 and 234, respectively, and panel members 225 and 232 are flat against side wall member 222, and panel members 228 and 229 are flat against side wall member 220. Again, the various panel members may be affixed into the indicated relative positions by adhesive or staples or the like, as previously described.

The cover sheet will be affixed by placing adhesive up the outer surfaces of front wall member 216 and back wall member 214, where they overlie panel members 223, 226, 234 and 231, respectively. Adhesive may also be applied, if desired to the exposed upper portions of those panel members, as well. Alternatively, the underside of the cover sheet may be coated with adhesive, as previously described, or alternative means of affixing the cover sheet may be employed. As no top panel members are provided, no adhesive is placed which would run across under the top side of the cover sheet.

The central sections of front wall member 216 and/or back wall member 214, if provided with tear-away panel members 218 or 215, respectively, may extend to the full height of bottom portion 219, since the tear-away panel members will allow inspection and access to the goods, after removal of the central portion of the cover sheet. Alternatively, as described with respect to the previous embodiment, if no tear-away panel members are provided, then the central section of at least one of front wall member 216 and back wall member 214 should be of less than the total overall height of bottom portion 219, to permit inspection and access to the goods.

The embodiment of FIGS. 5 and 6 is configured to be advantageously employed in the packaging and display of goods which are rectangular in shape and which may not require so much protection and support during stacking, as the goods which would be packaged in the display apparatus of the other embodiments. In the embodiment of FIGS. 5 and 6, once filled and the cover sheet is in place, the goods themselves, which may be further packaged in boxes, may assist in the support of the cover sheet, and in the support of the overall filled container configuration, during stacking of a plurality of such containers. Removal of the cover sheet will be in substantially the same manner as described with respect to the other embodiments.

Each of these embodiments features the advantage of providing a strong, protective, one-piece bottom, and a lighter-weight, different material cover, covering at least the entire front, top and rear of the container, so as assist in retaining the goods in the container and protecting the interior of the container from dust, etc., which container may also be used for display by removing a center section of the cover sheet in a facilitated manner.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A shipping container apparatus for goods, which apparatus is operably configured for conversion from a shipping configuration for the containment and transportation of goods to a display configuration for the facilitated presentation and display of said goods contained and shipped in said apparatus, said shipping container apparatus comprising:

a substantially self-supporting bottom portion, fabricated from a first material, the bottom portion including a bottom wall member, at least two first wall members operably emanating integrally from respective folds at respective bottom edges thereof from said bottom wall member at two substantially opposed first edges of said bottom wall member, at least two of said at least two first wall members having respective top edges operably disposed distal to said respective bottom edges thereof, said at least two first wall members being operably arranged relative to said bottom wall member so as to define and partially enclose a goods containing region having at least an open top portion, said bottom portion further including at least two second wall members, operably emanating integrally from respective folds at respective bottom edges thereof from said bottom wall member at two substantially opposed second edges of said bottom wall member, said opposed second edges of said bottom wall member being operably disposed in substantially alternating relation with said opposed first edges of said bottom wall member, at least one of said at least two second wall members being shorter in height than the height of the open top portion so as to permit visual inspection of and access to said goods containing region upon said conversion of said apparatus to said display configuration;

at least one of said at least two first wall members being operably configured so as to extend from said bottom wall member upwardly above said at least one of said at least two second wall members, up to a position substantially adjacent said open top portion of said container apparatus;

means for covering said goods containing region, operably configured so as to cover the substantial entirety of said at least two second wall members, at least portions of said top edges of said at least two first wall members, and said open top portion, said means for covering said goods containing region together with said bottom portion collectively, substantially fully enclosing and surrounding said goods in said shipping container apparatus;

said means for covering said goods containing region further including a substantially thin cover sheet member, operably positionable over said at least two second wall members, said at least portions of said top edge of at least one of said at least two first wall members, and said open top portion of said goods containing region, said means for covering said goods further being disposed in contact with said top edge of at least one of said at least two first wall members, at a position substantially adjacent the open top portion, said substantially thin cover sheet member further being configured from a second material substantially thinner than said first material; and means for facilitating conversion of said apparatus from said shipping configuration to said display configuration, by conditioning a substantial portion of said substantially thin cover sheet member to be severed and removed, in a facilitated manner, from a remaining portion of said substantially thin cover sheet member, which remaining portion remains substantially affixed to said container apparatus, so as to substantially uncover at least a portion of said open top portion of said goods containing region, the means for facilitating conversion of said apparatus from said shipping configuration to said display configuration further including a pair of spaced apart frangibility means for severing said cover sheet extending, in a non-intersecting manner, from respective positions proximate to a first edge of said cover member toward an opposite second edge of said cover member, along said cover sheet member, so as to substantially demarcate said cover sheet member into said portion to be severed and removed, and two remaining portions, disposed in spaced relation to one another by said portion to be severed and removed.

2. The shipping container apparatus according to claim 1 wherein said frangibility means comprises:

two parallel lines of perforations operably disposed in said substantially thin cover sheet member and extending from positions adjacent one of said bottom edges of one of said at least two second wall members, across said portion of said cover sheet member covering said open top portion of said goods containing region, to positions adjacent the bottom edge of another of said at least two second wall members.

3. The shipping container apparatus according to claim 1, wherein the cover sheet member comprises:

a sheet of kraft paper material.

4. The shipping container apparatus according to claim 1, wherein said bottom wall member, and said at least two first wall members, and said at least two second wall members, are formed from a single blank of container material.

5. The shipping container apparatus according to claim 4, wherein said single blank of container material is fabricated from corrugated paperboard material.

6. The shipping container apparatus according to claim 1, wherein said at least two second wall members further comprise:

at least a front wall member; and a back wall member.

7. The shipping container apparatus according to claim 1, further comprising:

a removable wall panel member operably disposed in at least one of said at least two second wall members for facilitating access to said goods containing region upon actuation of said means for facilitating conversion of said apparatus from said shipping configuration to said display configuration, by conditioning a portion of said substantially thin cover sheet member to be severed and removed.

8. The shipping container apparatus according to claim 1, wherein at least one of said at least two second wall members has a height substantially less than either of said first wall members, and, in turn, less than an overall height of said shipping container apparatus, so as to permit visual inspection of and access to said goods containing region.

* * * * *